US006434804B1

(12) United States Patent
Cornet et al.

(10) Patent No.: US 6,434,804 B1
(45) Date of Patent: Aug. 20, 2002

(54) CASKET BED

(75) Inventors: James L. Cornet, Oxford, MS (US); Steven A. Ferragut, Bradford, MA (US); C. David Hayes, Campbellsville, KY (US); Roger L. Reuss, Brookville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/209,970

(22) Filed: Dec. 11, 1998

(51) Int. Cl.[7] ..... A61G 17/00
(52) U.S. Cl. ..... 27/2; 5/191; 5/201; 5/238
(58) Field of Search ..... 27/2, 12, 27, 28, 27/32, 35, 1; 5/200.1, 201, 191, 282.1, 285, 286, 236.1, 238, 186.1, 189

(56) References Cited

U.S. PATENT DOCUMENTS

| | | | | | |
|---|---|---|---|---|---|
| 71,634 | A | * | 12/1867 | Oleff | |
| 268,500 | A | * | 12/1882 | Knowles | |
| 271,945 | A | * | 2/1883 | Strowger | |
| 297,868 | A | * | 4/1884 | Stam | 5/200.1 |
| 746,211 | A | * | 12/1903 | Webb | 5/286 X |
| 852,776 | A | * | 5/1907 | Druding | |
| 964,480 | A | * | 7/1910 | Bair | 5/200.1 X |
| 1,101,934 | A | * | 6/1914 | Hudry | 5/191 |
| 1,288,931 | A | * | 12/1918 | Lavezzi | 5/191 |
| 1,800,793 | A | * | 4/1931 | Harms | |
| 2,100,393 | A | * | 11/1937 | Hamilton | 5/191 |
| 2,553,807 | A | * | 5/1951 | Brands | |
| 2,577,685 | A | * | 12/1951 | Houle | 5/200.1 |
| 3,605,142 | A | * | 9/1971 | Weinhart | 5/282.1 X |
| 4,881,306 | A | | 11/1989 | Ernat et al. | |
| 5,615,464 | A | * | 4/1997 | Rojdev | 27/12 X |

OTHER PUBLICATIONS

ShurLok, *Bed Spring Supports*, 2 pages, Undated.

* cited by examiner

*Primary Examiner*—Jack Lavinder
*Assistant Examiner*—William L. Miller
(74) *Attorney, Agent, or Firm*—Wood, Herron & Evans, L.L.P.

(57) ABSTRACT

A casket bed comprises a rectangular bed frame formed from a pair of side rails, a pair of end rails, a plurality of cross braces spanning between the side rails and a plurality of bed straps spanning between the end rails. The cross braces are adjustably movable along the side rails. The bed straps have first ends directly connected to one of the end rails. Each cross brace includes a plurality of locators thereon each of which receives a bed strap and locates the bed strap side-to-side on the bed frame. The side and end rails are formed from beams L-shaped in cross-section which overlap at the corners of the frame; at each corner, one of the beams has a tongue which cooperates with its horizontal leg to receive therebetween the free edge of the horizontal leg of the other beam.

30 Claims, 3 Drawing Sheets

CASKET BED

FIELD OF THE INVENTION

This invention relates generally to caskets, and more particularly to beds for caskets and construction techniques therefore.

BACKGROUND OF THE INVENTION

Caskets typically include a bed mounted in the shell thereof for supporting a body thereon. One typical casket bed includes a pair of side rails and a pair of end rails, configured into a rectangular frame. Center rails span the width of the frame. The side rails, end rails and center rails are fabricated of "angle irons", i.e. steel beams having an L-shaped cross section. The side and end rails are spot welded together at the corners of the frame; similarly, the center rails are spot welded to the side rails.

To complete the assembly of this typical prior art casket bed, bed straps are installed on the frame. More specifically, each end rail includes a plurality of holes therein. Each bed strap, i.e. steel band, includes a hole in either end thereof. At first ends of the straps C-clips are passed through the holes in the straps and through the holes in the end rail. Tension springs connect the second ends of the straps to the other end rail. Each tension spring includes opposed legs, one of which is hooked through the hole in the end of the bed strap, and the other of which is hooked through the hole in the end rail.

Such typical prior art casket beds are subject to a number of criticisms. First, the numerous spot welding steps are tedious and time consuming to perform. Second, the spot welds are subject to breakage. Third, welding generates noxious fumes and can be a fire hazard. Fourth, the bed straps tend to undesirably slide from side-to-side on the center rails. Fifth, the center rails are not adjustable among the length of the casket bed, since they are fixed as by welding to the rails; occasionally circumstances present themselves to funeral directors wherein it would be desirable for a funeral director to be able to adjust the position of the center rails along the length of the casket bed frame, e.g. to accommodate a specific type or size of body. Sixth, the number of individual piece parts required to assemble a completed casket bed of this type is undesirably high.

SUMMARY OF THE INVENTION

The present invention, in its several aspects, overcomes the above disadvantages of typical prior art casket beds. In one aspect, the invention is a casket bed comprising a rectangular bed frame formed from a pair of side rails and a pair of end rails, a plurality of cross braces spanning between the side rails, and a plurality of bed straps spanning between the end rails; the cross braces are adjustably movable along the side rails. The cross braces are preferably slidable along the side rails. The side rails are preferably L-shaped in cross-section each having a horizontal leg and a vertical leg. Each cross brace has a pair of ends each of which is preferably configured into a down-turned U-shape. The down-turned U-shaped cross brace ends slide over the vertical legs of the side rails.

In another aspect, the invention is a casket bed comprising a rectangular bed frame formed from a pair of side rails and a pair of end rails, a plurality of cross braces spanning between the side rails, and a plurality of bed straps spanning between the end rails; the bed straps have first ends directly connected to one of the end rails. Either the first ends of the bed straps or one of the end rails include holes therein. The other of the first ends of the bed straps and end rail include projections thereon. The projections are positioned in the holes. Preferably, the first ends of the bed straps include the holes therein, and the end rail includes the projections thereon. Even more preferably, the end rail includes a plurality of tangs integrally formed therewith, with the tangs positioned in the holes.

In yet another aspect, a casket bed comprises a rectangular bed frame formed from a pair of side rails and a pair of end rails, a plurality of cross braces spanning between the side rails, and a plurality of bed straps spanning between the end rails; each cross brace includes a plurality of locators thereon each of which receives one bed strap and locates the bed strap side-to-side on the frame. The locators are preferably raised areas on the upper surfaces of the cross braces.

In still another aspect, a casket bed comprises a rectangular bed frame having a width, a length and four corners and formed from a plurality of beams L-shaped in cross-section, the beams overlapping at the corners of the frame, a plurality of cross braces spanning the width of the frame, and a plurality of bed straps spanning the length of the frame; at each comer of the frame, one of the beams has a tongue which cooperates with a horizontal leg of the one beam to receive therebetween a free edge of a horizontal leg of the other beam. The tongue is preferably generally parallel to the horizontal leg of the one beam. The one beam, i.e. the beam which includes the tongue, is preferably an end rail of the frame. The horizontal leg of the one beam preferably further includes an upturned end portion against which is received a vertical leg of the other beam. The upturned portion is preferably generally perpendicular to the horizontal leg of the one beam.

The invention thus solves a number of the problems posed by traditional spot welded angle iron casket beds. First, the cross braces of the casket bed of this invention are adjustable along the side rails thereby allowing a funeral director to adjust the casket bed to fit a particular body. Second, the ends of the bed straps are connected directly to the end rail, thus eliminating the "C" clips normally required to connect the bed straps to the end rail. Thus, the overall number of parts required to assemble a casket bed of this invention is less than that of the above-described prior art casket bed. Third, the cross braces of the casket bed of this invention are provided with locators which receive and locate the bed straps side-to-side on the frame, thereby preventing undesirable side-to-side movement of the straps on the frame. And fourth, the casket bed of this invention does not require any fasteners such as nuts and bolts or rivets, nor welding, for assembly in view of the snap together and/or slide together connections of the side rails to the end rails and of the cross braces to the side rails.

These and other advantages of the present invention will become more readily apparent during the following detailed description taken in conjunction with the drawings herein, in which:

DETAILED DESCRIPTION OF THE INVENTION

Figure 1:
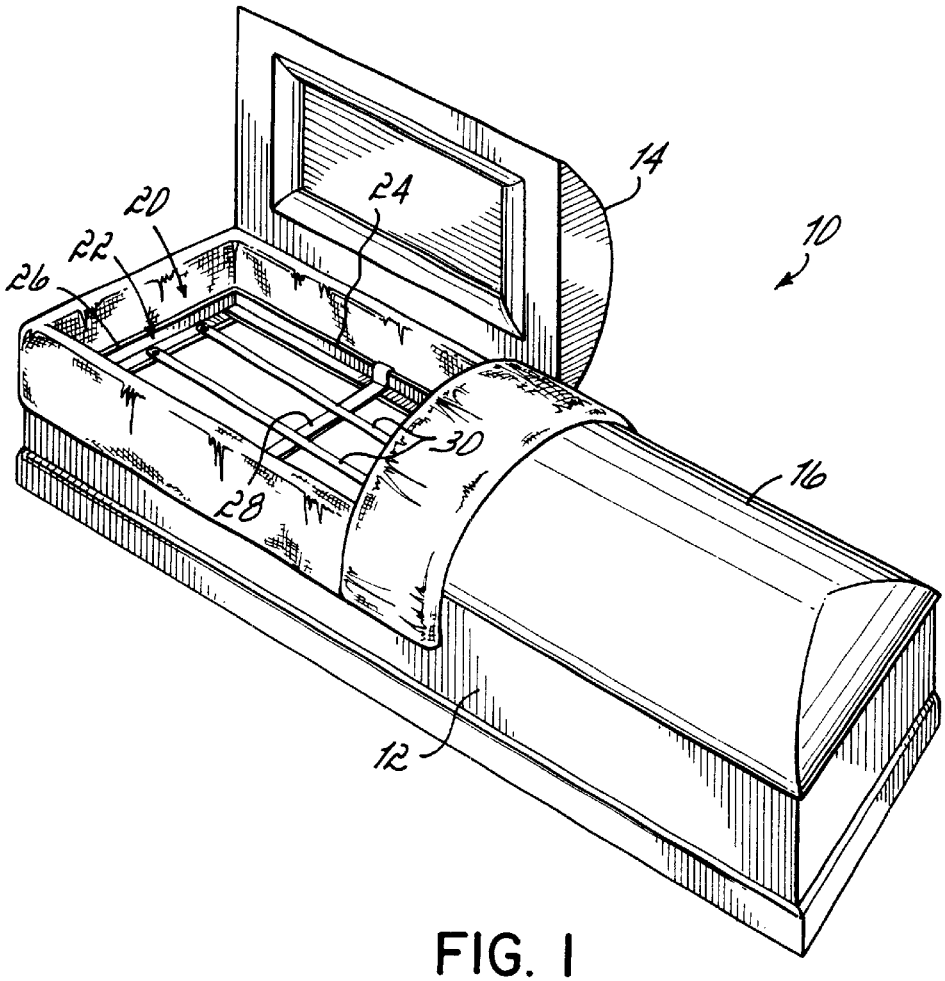
FIG. 1 is a perspective view of a casket including the casket bed of the present invention mounted therein.

Referring first to FIG. 1, there is illustrated a casket 10 comprised of a casket shell 12, a head end cap 14 closeable upon the shell 12 and a foot end cap 16 likewise closeable upon the shell 12. A casket bed 20 according to the present invention is mounted within the shell 12 of the casket 10.

Figure 4:
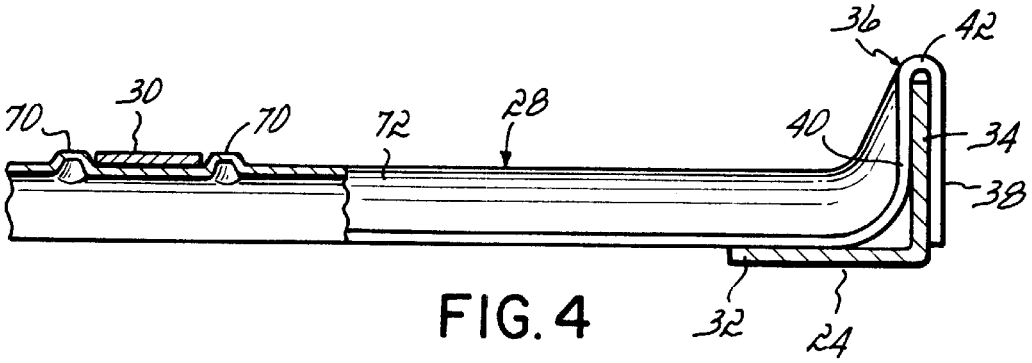
FIG. 4 is a view taken along line 4—4 of FIG. 3.
Figure 2:
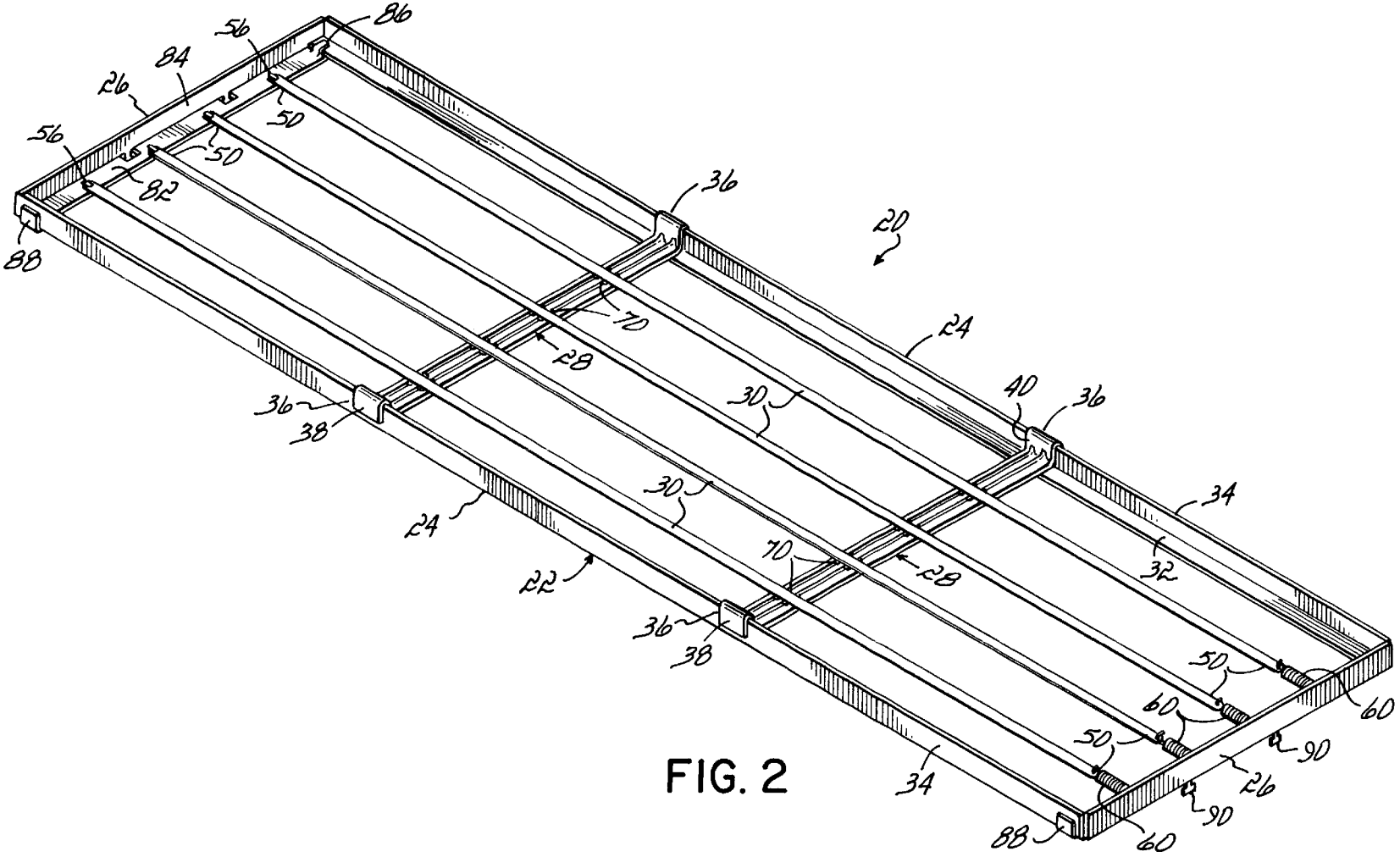
FIG. 2 is a perspective view of the casket bed of FIG. 1.
Figure 3:
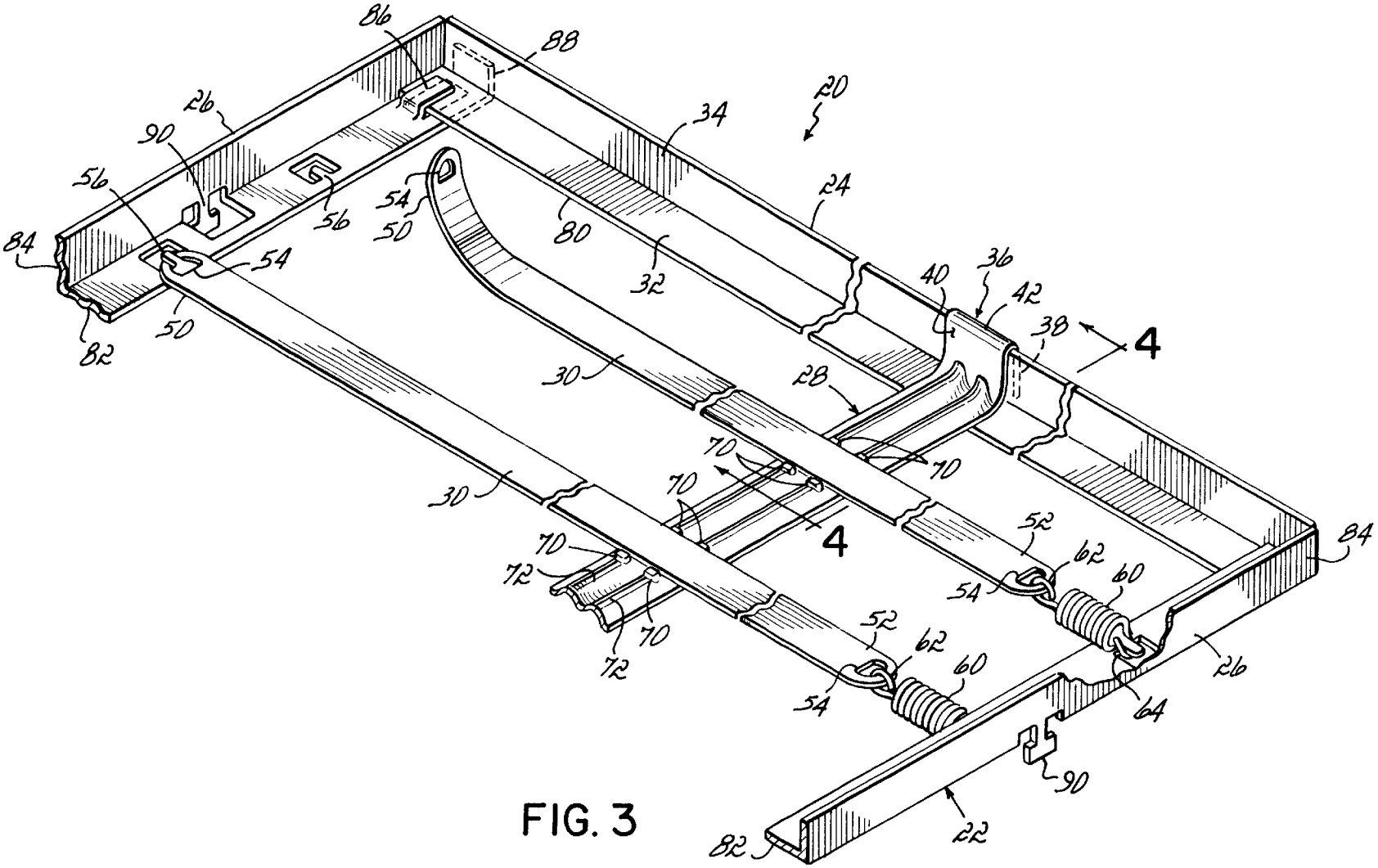
FIG. 3 is an enlarged perspective view of one half of the casket bed of FIG. 2, measured width-wise.

Referring now to FIGS. 2–4, the casket bed 20 is shown in greater detail. The casket bed 20 includes a rectangular bed frame 22. The rectangular bed frame 22 is formed from a pair of side rails 24, 24 and a pair of end rails 26, 26. A plurality of cross braces 28, two being illustrated, span between the side rails 24. A plurality of bed straps 30 span between the end rails 26. As will be described subsequently in more detail, the cross braces 28 are adjustably movable along the side rails 24 of the bed frame 22.

In particular, the cross braces 28 are slidable along the side rails 24. Each side rail 24 is L-shaped in cross-section and has a horizontal leg 32 and a vertical leg 34. Each cross brace 28 has a pair of ends 36, 36, each of which is configured into a down-turned U-shape. This U-shaped end 36 includes legs 38, 40 interconnected by a web 42. Thus, the down-turned U-shaped cross brace ends 36 slide over the vertical legs 34 of the side rails 24, i.e. the vertical legs 34 of the side rails 24 fit between the legs 38 and 40 of the cross brace ends 36. The cross brace ends 36, once installed over the vertical legs 34 of the side rails 24, are slidable along the side rails 24.

Referring now to FIGS. 2 and 3, it will be seen that the bed straps each include first ends 50 and second ends 52. The ends 50 and 52 each include holes 54 therein. The first ends 50 of the bed straps 30 are directly connected to the end rail 26.

More particularly, the end rail 26 includes projections which take the form of tangs 56 integrally formed therewith. The first ends 50 of the bed straps 30 are placed over the tangs 56 such that the tangs 56 are positioned in the holes 54. Thus, no additional connectors are required to connect the first ends 50 of the bed straps 30 to the end rail 26.

At the second ends 52 of the bed straps 30, tension springs 60 connect the bed straps 30 to the end rail 26. Each tension spring 60 includes opposed arms 62 and 64. The arm 62 passes through hole 54 in end 52 of bed strap 30; arm 64 passes around or over tang 56 formed in end rail 26.

Referring now to FIGS. 2, 3 and 4, and in particular FIGS. 3 and 4, each cross brace 28 includes a plurality of locators 70 thereon each of which receives one bed strap 30 and locates that bed strap 30 side-to-side on the frame 22. The locators 70 take the form of raised areas on the upper surfaces of two stiffening ribs 72, 72 which span the length of the cross braces 28. Thus, cross braces 28 vertically support the bed straps 30, each of which is laterally maintained in position by two pairs of locators 70.

Referring to FIG. 3, and as previously described, each side rail 24 includes a horizontal leg 32 and a vertical leg 34. Horizontal leg 32 includes a free edge 80. End rails 26 are likewise L-shaped in cross section each including a horizontal leg 82 and a vertical leg 84. The horizontal legs 82 of the end rails 26 each include a tongue 86. The tongue 86 and horizontal leg 82 of the end rail 26 cooperate to receive therebetween the free edge 80 of the horizontal leg 32 of the side rail 24.

More particularly, tongue 86 is preferably generally parallel to the horizontal leg 82 of the end rail 26. The horizontal leg 82 of each end rail 26 further preferably includes an upturned end portion 88 against which is received the vertical leg 34 of the side rail 24. The upturned portion 88 is preferably generally perpendicular to the horizontal leg 82 of the end rail 26.

The side rails 24 are preferably simply lengths of stock angle iron. The end rails 26 are preferably fabricated as steel stampings. Similarly, the cross braces 28 are preferably fabricated as steel stampings.

To assemble the casket bed 10 of this invention, the angle iron side rails 24 are first assembled to the end rails 26 by slipping the horizontal legs 32 of the side rails 24 between the tongues 86 and horizontal legs 82 of the end rails 26, with the vertical legs 34 of the side rails 24 positioned inwardly of and against the upturned portions 88 of the horizontal legs 82 of the end rails 26. Next, the cross braces 28 are slipped downwardly over the vertical legs 34 of the side rails 24 and are slid into their appropriate positions along the length of the frame 22. The springs 60 are connected to the ends 52 of the bed straps 30 and to the tangs 56 of one end rail 26. The straps 30 are positioned between the locators 70 and atop the cross braces 28 and the holes 54 in the ends 50 of the bed straps 30 are positioned over the tangs 56 in the other end rail 26. The assembled bed frame 20 is then mounted within the casket shell 12 as is conventional. To that end, each end rail 26 may include an additional pair of downwardly directed T-shaped tangs 90 for interconnection to a lift/tilt mechanism mounted within the shell 12 (not shown, but known to those skilled in the art).

The casket bed 20 of this invention thus eliminates welding, as well as all fasteners such as nuts and bolts or rivets. Instead, the side rails 24, end rails 26 and cross braces 28 simply snap together and/or slide together. The cross braces 28 are fully adjustable along the length of the bed frame 22. Additional cross braces 28 may be installed by a funeral director to the bed frame 22 as needed. The direct connections of the bed straps 30 to the end rails 26 by way of the integral tangs 56 eliminate the C-clips normally required to make those connections, thereby reducing the overall number of parts required to assemble the casket bed 20. And, the locators 70 on the cross braces 28 locate the bed straps 30 side-to-side on the frame 22 thereby preventing undesirable side-to-side movement of the straps 30 on the frame 22.

Those skilled in the art will readily recognize numerous adaptations and modifications which can be made to the present invention which will result in an improved casket bed, yet all of which will fall within the spirit and scope of the present invention as defined in the following claims. Accordingly, the invention is to be limited only by the scope of the following claims and their equivalents.

What is claimed is:

1. A casket bed comprising:

a rectangular bed frame formed from a pair of side rails and a pair of end rails;

a plurality of cross braces spanning between said side rails; and a plurality of bed straps spanning between said end rails;

said bed straps having first ends directly connected to one of said end rails;

wherein one of said first ends of said bed straps and said one end rail include holes therein and the other of said first ends of said bed straps and said one end rail include projections thereon, said projections positioned in said holes;

wherein said first ends of said bed straps include holes therein and said one end rail includes projections thereon, said projections positioned in said holes;

wherein said one end rail includes a plurality of tangs integrally formed therewith, said tangs positioned in said holes.

2. The casket bed of claim 1, said cross braces being adjustably movable along said side rails.

3. The casket bed of claim 1, each said cross brace including a plurality of locators thereon each of which receives one said bed strap and locates said one bed strap side-to-side on said frame.

4. A casket bed comprising:

a rectangular bed frame having a width, a length and four corners and formed from a plurality of beams L-shaped in cross-section, said beams overlapping at said corners of said frame;

a plurality of cross braces spanning the width of said frame; and a plurality of bed straps spanning the length of said frame;

at each said corner of said frame, one of said beams having a tongue which cooperates with a horizontal leg of said one beam to receive therebetween a free end of a cantilevered horizontal leg of the other said beam.

5. The casket bed of claim 4 wherein said tongue is generally parallel to said horizontal leg of said one beam.

6. The casket bed of claim 4 wherein said one beam is an end rail of said frame.

7. A casket bed comprising:

a rectangular bed frame having a width, a length and four corners and formed from a plurality of beams L-shaped in cross-section, said beams overlapping at said corners of said frame;

a plurality of cross braces spanning the width of said frame; and a plurality of bed straps spanning the length of said frame;

at each said corner of said frame, one of said beams having a tongue which cooperates with a horizontal leg of said one beam to receive therebetween a free edge of a horizontal leg of the other said beam; and wherein said horizontal leg of said one beam includes an upturned end portion against which is received a vertical leg of said other beam.

8. The casket bed of claim 7 wherein said upturned portion is generally perpendicular to said horizontal leg of said one beam.

9. The casket bed of claim 7, said cross braces being adjustably movable along the length of said frame.

10. The casket bed of claim 9 wherein said upturned portion is generally perpendicular to said horizontal leg of said one beam.

11. The casket bed of claim 7, said plurality of beams including a pair of end rails, said bed straps having first ends directly connected to one of said end rails.

12. The casket bed of claim 11 wherein said upturned portion is generally perpendicular to said horizontal leg of said one beam.

13. The casket bed of claim 7, each said cross brace including a plurality of locators thereon each of which receives one said bed strap and locates said one bed strap side-to-side on said frame.

14. The casket bed of claim 13 wherein said upturned portion is generally perpendicular to said horizontal leg of said one beam.

15. A casket bed comprising:

a rectangular bed frame having a width, a length and four corners and formed from a plurality of beams L-shaped in cross-section, said beams overlapping at said corners of said frame;

a plurality of cross braces spanning the width of said frame; and a plurality of bed straps spanning the length of said frame;

each of said cross braces including opposing ends, each of said opposed ends including structure thereon cooperating with a respective one of said side rails permitting relative movement therebetween;

said cross braces thereby being selectively adjustable movable along the length of said frame;

at each said corner of said frame, one of said beams having a tongue which cooperates with a horizontal leg of said one beam to receive therebetween a free end of a cantilevered horizontal leg of the other said beam.

16. The casket bed of claim 15 wherein said plurality of beams includes a pair of side rails and wherein said cross braces are slidable along said side rails.

17. The casket bed of claim 15 wherein said tongue is generally parallel to said horizontal leg of said one beam.

18. The casket bed of claim 15 wherein said one beam is an end rail of said frame.

19. A casket bed comprising:

a rectangular bed frame having a width, a length and four corners and formed from a plurality of beams L-shaped in cross-section, said beams overlapping at said corners of said frame;

a plurality of cross braces spanning the width of said frame; and a plurality of bed straps spanning the length of said frame;

said cross braces being adjustably movable along the length of said frame;

at each said corner of said frame, one of said beams having a tongue which cooperates with a horizontal leg of said one beam to receive therebetween a free end of a cantilevered horizontal leg of the other said beam;

wherein said plurality of beams includes a pair of side rails and wherein said cross braces are slidable along said side rails; and wherein said side rails each have a horizontal leg and a vertical leg, and each said cross brace has a pair of ends each of which is configured into a down-turned U-shape and wherein said down-turned U-shaped cross brace ends slide over said vertical legs of said side rails.

20. A casket bed comprising:

a rectangular bed frame having a width, a length and four corners and formed from a plurality of beams L-shaped in cross-section, said beams overlapping at said corners of said frame;

a plurality of cross braces spanning the width of said frame; and a plurality of bed straps spanning the length of said frame;

said plurality of beams including a pair of end rails, said bed straps having first ends directly connected to one of said end rails and second ends connected to the other of said end rails via a resilient member;

at each said corner of said frame, one of said beams having a tongue which cooperates with a horizontal leg of said one beam to receive therebetween a free end of a cantilevered horizontal leg of the other said beam.

21. The casket bed of claim 20 wherein one of said first ends of said bed straps and said one end rail include holes therein and the other of said first ends of said bed straps and said one end rail include projections thereon, said projections positioned in said holes.

22. The casket bed of claim 21 wherein said first ends of said bed straps include holes therein and said one end rail includes projections thereon, said projections positioned in said holes.

23. The casket bed of claim 20 wherein said tongue is generally parallel to said horizontal leg of said one beam.

24. The casket bed of claim 20 wherein said one beam is an end rail of said frame.

25. A casket bed comprising:

a rectangular bed frame having a width, a length and four corners and formed from a plurality of beams L-shaped in cross-section, said beams overlapping at said corners of said frame;

a plurality of cross braces scanning the width of said frame; and a plurality of bed straps spanning the length of said frame;

said plurality of beams including a pair of end rails, said bed straps having first ends directly connected to one of said end rails;

at each said corner of said frame, one of said beams having a tongue which cooperates with a horizontal leg of said one beam to receive therebetween a free edge of a horizontal leg of the other said beam;

wherein one of said first ends of said bed straps and said one end rail include holes therein and the other of said first ends of said bed straps and said one end rail include projections thereon, said projections positioned in said holes;

wherein said first ends of said bed straps include holes therein and said one end rail includes projections thereon, said projections positioned in said holes; and wherein said one end rail includes a plurality of tangs integrally formed therewith, said tangs positioned in said holes.

26. A casket bed comprising:

a rectangular bed frame having a width, a length and four corners and formed from a plurality of beams L-shaped in cross-section, said beams overlapping at said corners of said frame;

a plurality of cross braces spanning the width of said frame; and a plurality of bed straps spanning the length of said frame;

each said cross brace including a plurality of locators thereon each of which receives one said bed strap and locates said one bed strap side-to-side on said frame;

at each said corner of said frame, one of said beams having a tongue which cooperates with a horizontal leg of said one beam to receive therebetween a free end of a cantilevered horizontal leg of the other said beam.

27. The casket bed of claim 26 wherein said locators are raised areas on an upper surface of said cross braces.

28. The casket bed of claim 26 wherein said tongue is generally parallel to said horizontal leg of said one beam.

29. The casket bed of claim 26 wherein said one beam is an end rail of said frame.

30. A casket bed comprising:

a rectangular bed frame having a width, a length and four corners and formed from a plurality of beams L-shaped in cross-section, said beams overlapping at said corners of said frame;

a plurality of cross braces spanning the width of said frame; and a plurality of bed straps spanning the length of said frame;

each of said cross braces including opposing ends, each of said opposed ends including structure thereon cooperating with a respective one of said side rails permitting relative movement therebetween;

said cross braces thereby being selectively adjustably movable along the length of said frame;

said plurality of beams including a pair of end rails, said bed straps having first ends directly connected to one of said end rails and second ends connected to the other of said end rails via a resilient member;

each said cross brace including a plurality of locators thereon each of which receives one said bed strap and locates said one bed strap side-to-side on said frame;

at each said corner of said frame, one of said beams having a tongue which cooperates with a horizontal leg of said one beam to receive therebetween a free end of a cantilevered horizontal leg of the other said beam.

* * * * *